US006572351B2

(12) United States Patent
Durand et al.

(10) Patent No.: US 6,572,351 B2
(45) Date of Patent: Jun. 3, 2003

(54) PRESSURE SEAL FOR A VACUUM PUMP

(75) Inventors: Pascal Durand, La Balme de Sillingy (FR); Emmanuel Bourgeois, Metz Tessy (FR)

(73) Assignee: Alcatel, Paris (FR)

( * ) Notice: Subject to any disclaimer, the term of this patent is extended or adjusted under 35 U.S.C. 154(b) by 0 days.

(21) Appl. No.: 10/110,967

(22) PCT Filed: Aug. 9, 2001

(86) PCT No.: PCT/FR01/02581

§ 371 (c)(1),
(2), (4) Date: Apr. 18, 2002

(87) PCT Pub. No.: WO02/16773

PCT Pub. Date: Feb. 28, 2002

(65) Prior Publication Data

US 2002/0155014 A1 Oct. 24, 2002

(30) Foreign Application Priority Data

Aug. 21, 2000 (FR) ..... 00 10744

(51) Int. Cl.[7] ..... F03C 2/00
(52) U.S. Cl. ..... 418/9; 418/149
(58) Field of Search ..... 418/9, 13, 149, 418/206.6

(56) References Cited

U.S. PATENT DOCUMENTS

| | | | | | |
|---|---|---|---|---|---|
| 3,294,028 | A | * | 12/1966 | Dahl | 418/149 |
| 3,473,476 | A | * | 10/1969 | Davidson | 418/206.6 |
| 4,492,545 | A | * | 1/1985 | Mochizuki et al. | 418/149 |
| 4,531,535 | A | * | 7/1985 | Kiernan et al. | 137/99 |
| 4,671,749 | A | * | 6/1987 | Naraki et al. | 418/149 |
| 6,005,214 | A | | 12/1999 | Cramer | |

FOREIGN PATENT DOCUMENTS

| | | | | |
|---|---|---|---|---|
| EP | 337681 | A2 * | 10/1989 | F04C/23/00 |
| EP | 0 476 631 | A1 | 3/1992 | |
| EP | 1 020 645 | A1 | 7/2000 | |
| JP | 3-145594 | A | 6/1991 | |

* cited by examiner

*Primary Examiner*—Thomas Denion
*Assistant Examiner*—Theresa Trieu
(74) *Attorney, Agent, or Firm*—Sughrue Mion, PLLC

(57) ABSTRACT

The invention concerns a vacuum pump consisting in the assembly of two stator half-shells (101, 102) and two directly mounted end parts (31, 32) with an interposed single-piece continuous pressure seal (33). The pressure seal (33) comprises two annular end parts (34, 35) generally parallel to each other and connected by two side-members (36, 37) which are generally perpendicular thereto. Thus, the number of components to be assembled to produce an multistage dry vacuum pump is reduced, while providing satisfactory impermeability to outside atmosphere.

11 Claims, 6 Drawing Sheets

PRESSURE SEAL FOR A VACUUM PUMP

TECHNICAL FIELD OF THE INVENTION

The present invention relates to multistage dry vacuum pumps such as Roots type multistage pumps, claw type pumps, and combined Roots-and-claw type pumps.

Such multistage dry vacuum pumps are made up of a plurality of compression stages connected in series.

FIGS. 1 and 2 show a multistage Roots type dry pump of the prior art. FIG. 2 is a perspective view in longitudinal section showing the stator of such a Roots pump. In the stator 1, between a gas inlet 2 and a gas outlet 3, there can be seen five successive compression chambers respectively referenced 4, 5, 6, 7 and 8. Adjacent chambers are separated by respective transverse walls 9, 10, 11, and 12 each pierced by two holes such as the holes 13 and 14 in the transverse wall 12 for passing the shafts of two parallel rotors, not shown, that are mechanically coupled together, and that carry compression lobes of the Roots or claw type. Adjacent chambers are interconnected via a gas flow duct such as the gas flow duct 15 connecting the delivery outlet of the first compression chamber 4 to the suction inlet of the second compression chamber 5.

The rotor lobes that penetrate into the compression chambers 4–8 are of a diameter that is greater than that of the rotor shafts that pass through the holes 13 and 14. It is therefore not possible to engage an entire rotor axially in the stator 1 by mere axial displacement. Nor is it possible to envisage machining a one-piece stator 1 in such a manner as to make the cavities constituting the compression chambers 4–8.

To make both machining and assembly possible, and also to provide good sealing, the stators of known dry vacuum pumps are generally built up as an axial assembly of a plurality of stator elements, respectively referenced 16, 17, 18, 19 and 20, which are assembled to one another via their respective front end walls such as the front end wall 21 of stator element 16, with interposed between the walls respective sealing rings 22, 23, 24, 25 and 26 that become compressed axially so as to isolate each compression chamber 4–8 from the outside atmosphere.

Such a structure for a dry pump of the Roots or claw type requires each stator element 16–20 to be machined separately, and then it requires an assembly operation to be performed that is lengthy and difficult, consisting in fitting both rotor shafts in a support frame, in adjusting the positions of the lobes in the last compression chamber 8, positioning the last stator element 20 together with the sealing ring 26, fitting the lobes for the last compression chamber but one 7, bringing the last stator element but one 19 together with the sealing ring 25 into position, and so on to the first stator element 16. Given that clearance between the rotor lobes and the walls of the stator is very small in order to seal each compression stage of the vacuum pump, it will be understood that such assembly is particularly lengthy and difficult to implement, and it is generally accepted that several hours of labor are required to perform this operation on a five-stage dry vacuum pump.

Another problem, in such known multistage dry vacuum pumps, is the difficulty of aligning the stator elements with one another, given that errors are liable to accumulate between the first stator element 16 and the last stator element 20, thus making it difficult to control the clearance between the rotors and the stator in mass production.

Documents EP 0 476 631 A and JP 03 145594 A describe vacuum pump structures having a stator made up of two half-shells that are assembled together radially with a longitudinal assembly surface generally parallel to the axes of the rotors, the stator being closed in leaktight manner as its ends by two fitted endpieces that are engaged axially. Those documents do not mention the advantage of such a stator structure in the form of two half-shells, and they do not describe means for providing sealing between the stator and the rotor.

The difficulty lies in the need both to provide peripheral radial sealing in the longitudinal assembly surface between the two half-shells so as to prevent gases passing between the outside atmosphere and the internal cavities of the pump, while simultaneously providing axial sealing at the ends between the half-shells and the fitted endpieces.

In traditional manner, it might be imagined that axial sealing at the ends could be provided by sealing rings of the kind shown in FIGS. 1 and 2 for the prior art pump, and that radial peripheral sealing could be provided by longitudinal gaskets compressed between the two half-shells. Unfortunately, that solution presents a major drawback stemming from the fact that leakage lines exist between the longitudinal gasket providing peripheral radial sealing and the O-rings providing axial sealing at the ends. Sealing therefore is unsatisfactory.

SUMMARY OF THE INVENTION

The problem posed by the present invention is that of designing a new multistage dry vacuum pump structure that makes it possible to reduce significantly the number of parts to be assembled during assembly, while facilitating assembly and enabling it to be performed more quickly, and while also providing sealing that is satisfactory between the internal cavities of the vacuum pump and the outside atmosphere so as to avoid any risks of the pumped gases being polluted by the outside atmosphere, and any risks of the outside atmosphere being polluted by the pumped gases.

The solution of the invention consists in providing a continuous one-piece sealing gasket which provides both types of sealing simultaneously in a stator structure in the form of two half-shells.

Thus, to achieve these objects, and others, the invention provides a multistage dry vacuum pump made up of a plurality of compression stages placed in series, the pump having at least one rotor mounted to rotate in a stator that is closed in leaktight manner at its ends by two fitted end pieces; furthermore:

the stator is made by radially assembling together two half-shells on a longitudinal assembly surface, each compression stage thus being contained in two corresponding portions of each of the half-shells, the two half-shells, once assembled together, containing all of the compression stages;

a continuous one-piece gasket serves to provide both peripheral radial sealing in the longitudinal assembly surface of the half-shells, and axial end sealing between the half-shells and the fitted end pieces so as to isolate the compression stages from the outside atmosphere.

In an advantageous embodiment, the gasket comprises two annular end portions that are generally parallel to each other and that are interconnected by two longitudinally-extending portions that are generally perpendicular thereto.

With a sealing gasket of this structure, in the assembled state, the longitudinally-extending portions of the gasket are compressed laterally between the two half-shells in the longitudinal assembly surface, while the two annular end portions are compressed between the two half-shells acting together on the one hand and the respective fitted end pieces on the other hand.

To provide good compression of the first annular end portion of the gasket, it is advantageous to provide a first fitted end piece that has an axial nose shaped to occupy a corresponding axial recess in the first end of the stator body as made up by the two assembled-together half-shells. In this way, the first annular end portion of the gasket is compressed radially by the two half-shells against the axial nose.

Preferably, the axial nose includes a peripheral annular groove for receiving said first annular end portion of the gasket.

To facilitate positioning the sealing gasket and to provide good compression of its longitudinally-extending portions, at least one of the half-shells has two longitudinal grooves in its longitudinal assembly surface for receiving the longitudinally-extending portions of the gasket.

The second annular end portion of the gasket may merely be compressed axially by the second fitted end piece against the end faces of the two half-shells.

Preferably, the two half-shells comprise respective grooves in their second end faces, which grooves are shaped to receive said second annular end portion of the gasket.

BRIEF DESCRIPTION OF THE DRAWINGS

Other objects, characteristics, and advantages of the present invention appear from the following description of particular embodiments, given with reference to the accompanying figures, in which.

DESCRIPTION OF THE PREFERRED EMBODIMENTS

Figure 1:
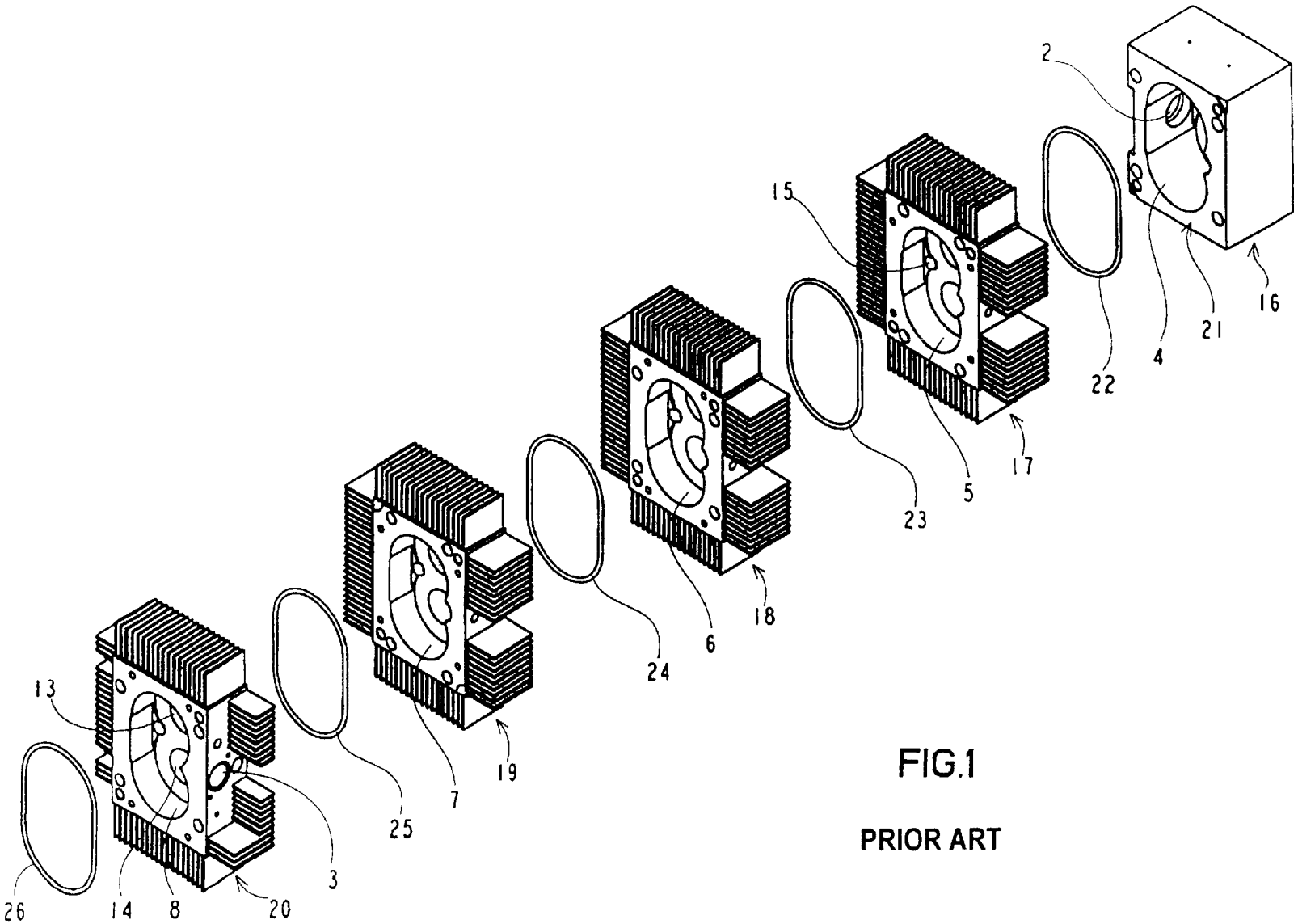
FIG.1 PRIOR ART
FIG. 1 is an exploded perspective view of a prior art structure for a multistage dry vacuum pump stator.
Figure 2:
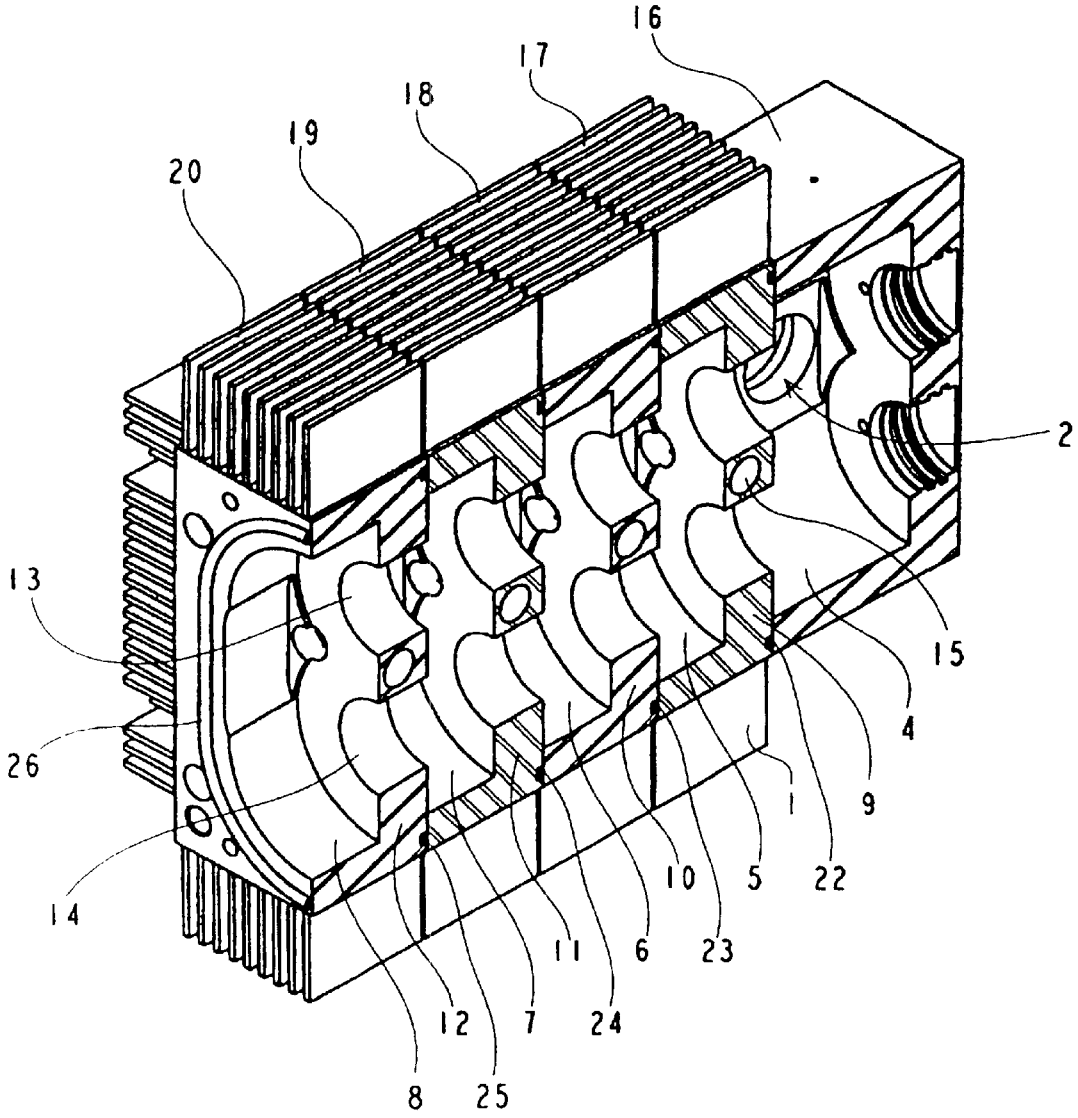
FIG.2 PRIOR ART
FIG. 2 is a perspective view in longitudinal section showing the FIG. 1 pump, after the stator has been assembled.
Figure 6:
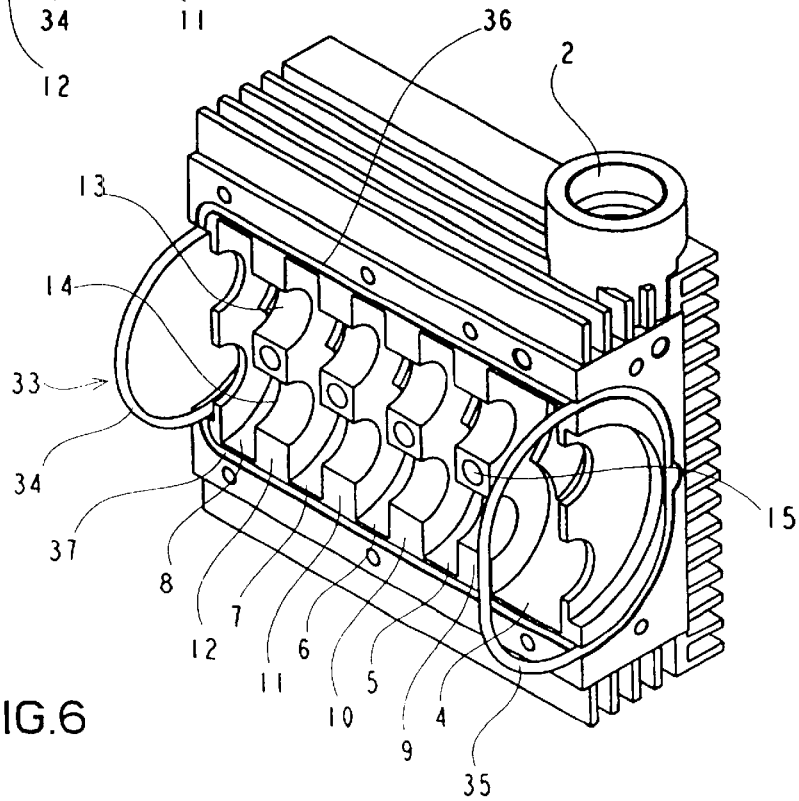
Figure 7:
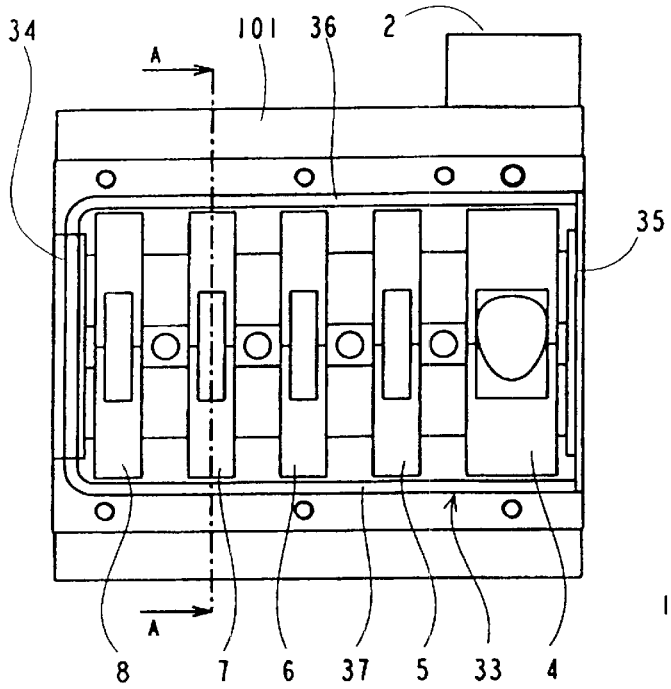
FIG. 7 is a side view showing the inside face of the stator half-shell of the preceding figures, with the sealing gasket in place.
Figure 8:
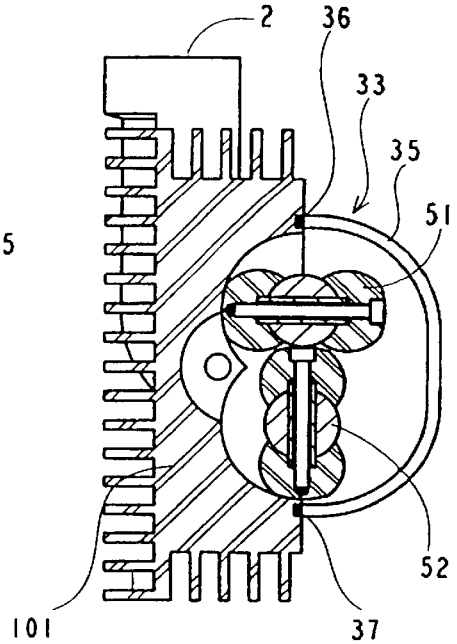
FIG. 8 is a cross-section of the half-shell and of the gasket of FIG. 7 on section plane A—A, with the rotors mounted.

In the embodiment of FIGS. 3 to 10, the multistage dry vacuum pump of the invention is a five-stage pump in which there can be seen the usual structural elements of the prior art pump as shown in FIGS. 1 and 2, and identified by the same numerical references. Thus, there are the gas inlet 2, a gas outlet that is not visible in the figures, the successive compression chambers 4, 5, 6, 7 and 8, the transverse walls 9, 10, 11 and 12 separating the compression chambers, the holes 13 and 14 for passing the rotor shafts, and the duct 15 for passing gas between two successive compression chambers. In FIG. 8, there can also be seen the rotors 51 and 52.

In the invention, the stator is made up of two half-shells respectively referenced 101 and 102, which shells meet on a longitudinal assembly surface 30. The longitudinal assembly surface 30 is preferably plane and contains the respective axes I—I and II—II (FIG. 3) of the two coupled-together rotor shafts.

As a result, after the half-shells 101 and 102 have been assembled together radially, each compression stage of the pump, e.g. the first compression stage constituted by the first compression chamber 4 and the rotor lobes it contains, is contained in two corresponding portions of each of the half-shells 101 and 102. In other words, once assembled together, the two half-shells 101 and 102 contain all of the compression stages of the pump.

The main stator body as constituted in this way by the assembled-together half-shells 101 and 102 is closed in leaktight manner at its ends by two fitted end pieces, respectively a first end piece 31 and a second end piece 32.

In the invention, sealing between the outside atmosphere and the internal cavities of the vacuum pump is provided by a continuous one-piece sealing gasket 33. In the embodiment shown in the figures, and most clearly visible in FIGS. 9 and 10, the sealing gasket 33 comprises two annular end portions 34 and 35 that are generally parallel to each other, and that are interconnected by two longitudinally-extending portions 36 and 37 which are generally perpendicular thereto. In this embodiment, which is adapted to the general structure of the above-described stator, the longitudinally-extending portions 36 and 37 of the gasket 33 are generally parallel to each other and they interconnect the two annular end portions 34 and 35 via respective connection zones 38, 39, 40 and 41 that are diagrammatically opposite in pairs.

Figure 9:
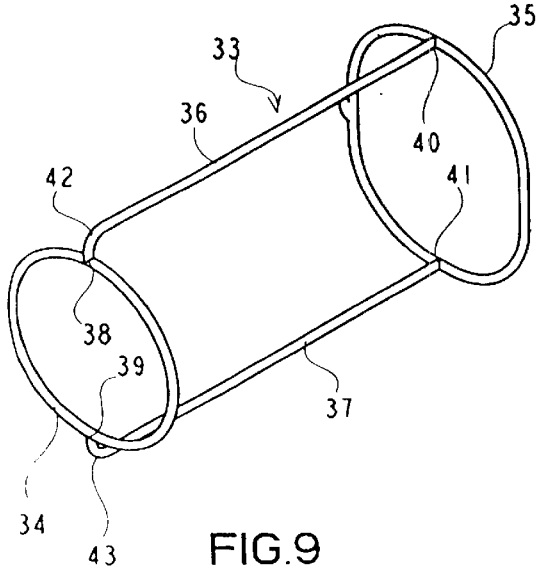
FIG. 9 is a perspective view of a sealing gasket constituting an embodiment of the present invention.

As can be seen in FIG. 9, in this embodiment, the first annular end portion 34 is generally circular and of smaller diameter than the second annular end portion 35 which is itself oblong in shape so as to fit around the space occupied by the coupled-together rotors that are offset vertically relative to each other. The longitudinally-extending portions 36 and 37 are axially connected directly to the top and bottom zones respectively of the second annular end portion 35, whereas they are connected radially via bends 42 and 43 to the first annular end portion 34.

Figure 10:
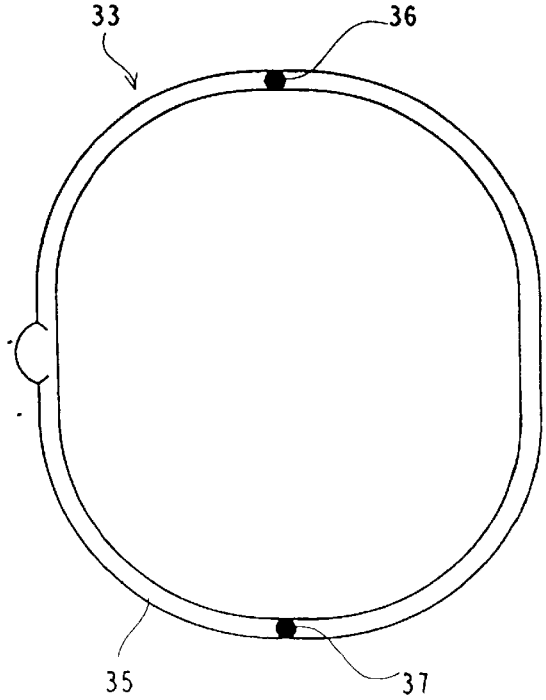
FIG. 10 is a cross-section view of the FIG. 9 sealing gasket.

In the embodiment of FIG. 10, the gasket 33 is substantially circular in cross-section, as can be seen where the longitudinally-extending portions 36 and 37 are in section. Nevertheless, it will be possible for the gasket to have a cross-section of some other shape, e.g. square, rectangular, etc. The gasket can be made of elastomer or of any suitable material such as a metal of the copper, aluminum, or indium type.

Figure 3:
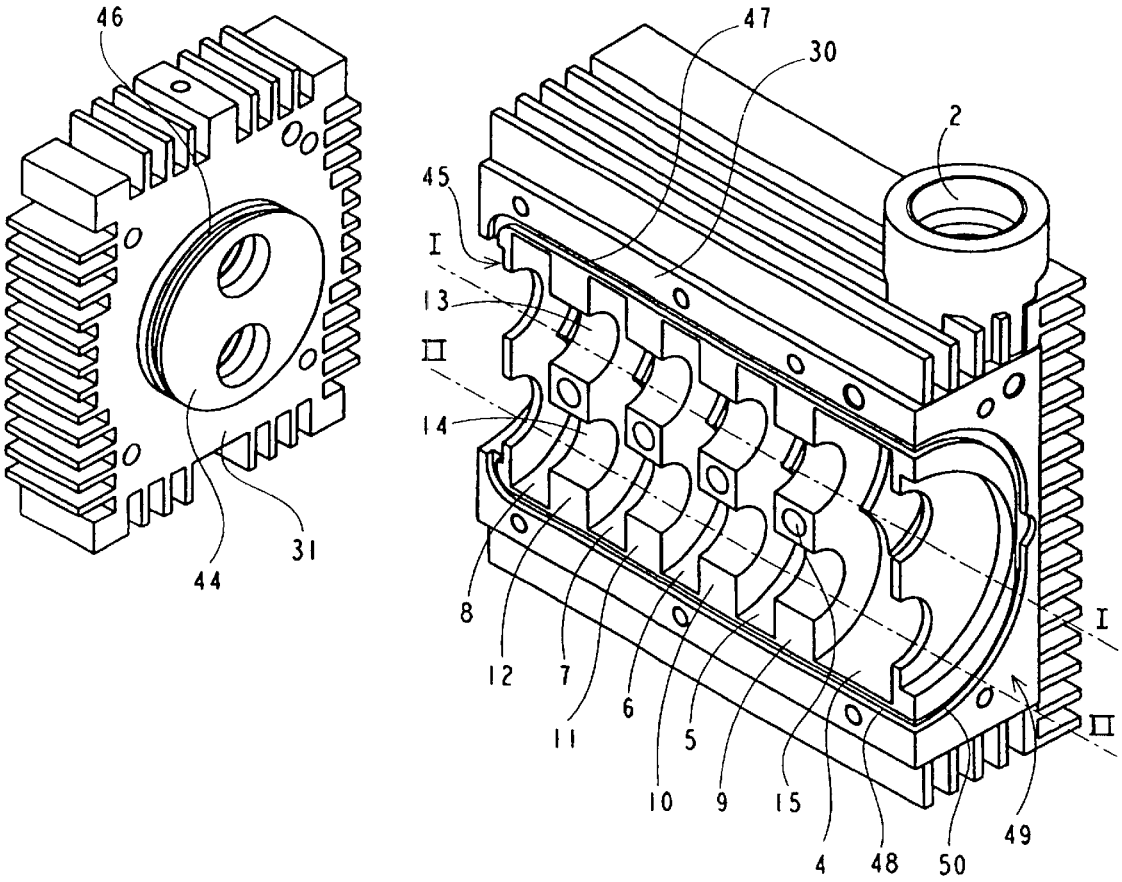
FIG. 3 is a perspective view showing a first stator half-shell and a first end piece for a dry vacuum pump constituting an embodiment of the present invention.
Figure 4:
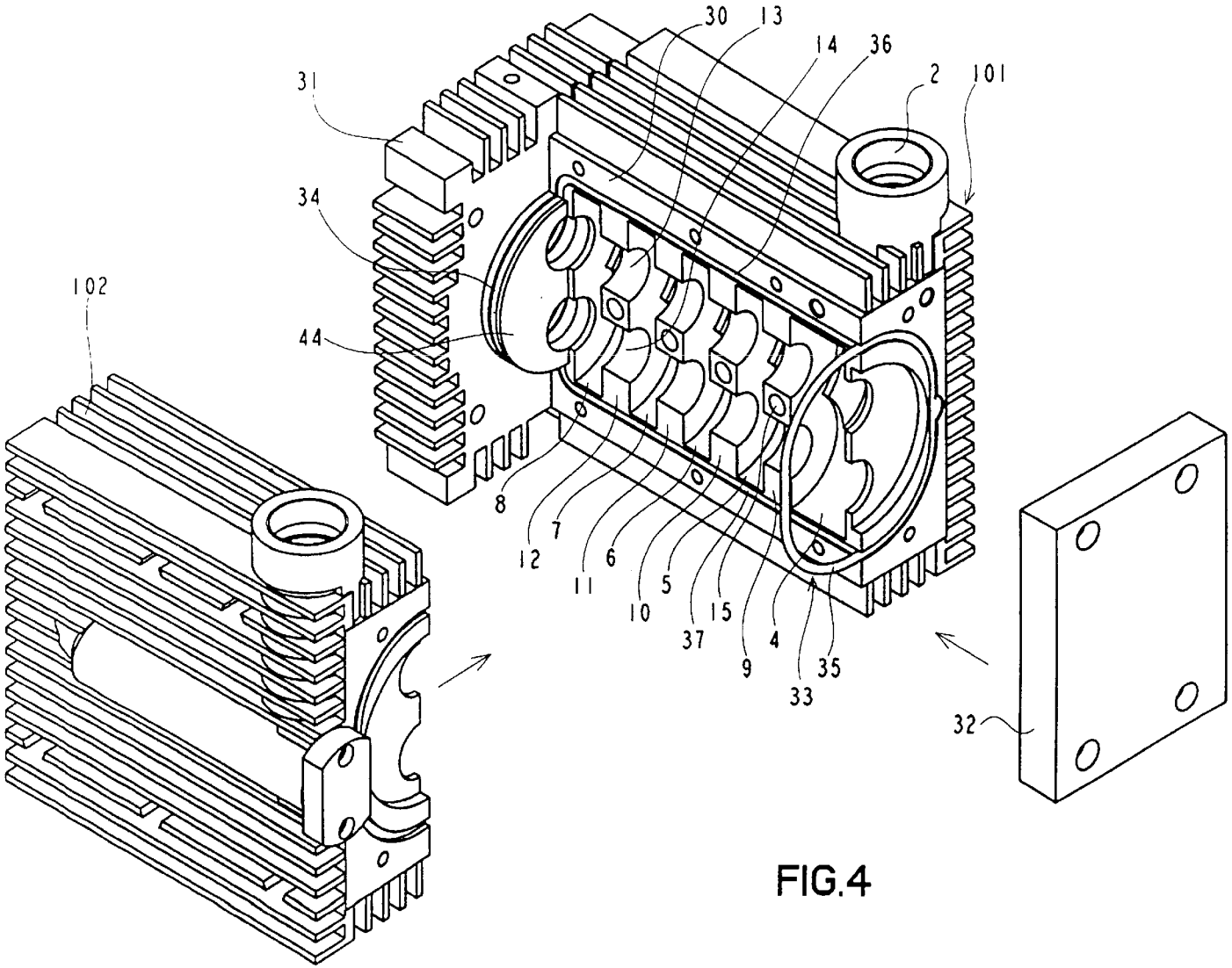
FIG. 4 is an exploded perspective view showing the first stator half-shell and the first end piece after they have been assembled together with a sealing gasket of the invention interposed between them, and also showing the second stator half-shell and the second end piece prior to assembly.

With reference more particularly to FIGS. 3 and 4, it can be seen that the first fitted end piece 31 has an axial nose 44 shaped to occupy a corresponding axial recess 45 in the first end of the stator. The axial nose 44 has a peripheral annular groove 46 for receiving the first annular end portion 34 of the gasket 33. As a result, in the assembled position, the first annular end portion 34 of the gasket 33 is compressed radially by the two half-shells 101 and 102 onto the axial nose 44 of the first fitted end piece 31. The annular groove 46 can be rectangular in cross-section, and of a depth that is smaller than the diameter of the gasket 33.

At least one of the half-shells 101 and 102, e.g. the half-shell 101, has two longitudinal grooves 47 and 48 (FIG.

Figure 5:
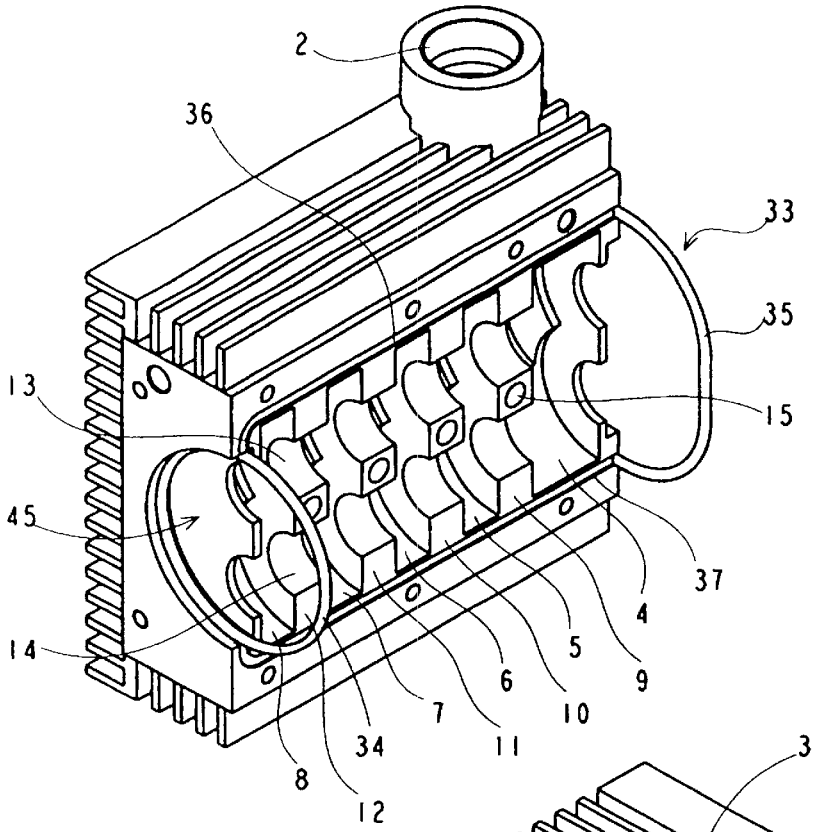
FIGS. 5 and 6 are perspective views from two different viewpoints showing a stator half-shell together with a sealing gasket for the embodiment of FIGS. 3 and 4.

3) in its longitudinal assembly surface 30 for receiving the longitudinally-extending portions 36 and 37 respectively of the gasket 33, as shown in FIGS. 4 to 6. As a result, the longitudinally-extending portions 36 and 37 of the gasket 33 are compressed laterally between the two half-shells 101 and 102 in the longitudinal assembly surface 30. The cross-section of the longitudinal grooves 47 and 48 can be rectangular, with depth smaller than the diameter of the gasket 33.

As can be seen in FIG. 4 and in FIG. 7, the second annular end portion 35 of the gasket 33 is compressed axially by the second fitted end piece 32 of the stator against the two half-shells 101 and 102. In the embodiment shown, the two half-shells 101 and 102 have grooves in their end faces at the second end such as the end face 49 of the first half-shell 101 (FIG. 3), these grooves, such as the groove 50, being shaped to receive the second annular end portion 35 of the gasket 33. The section of the grooves such as the groove 50 can be rectangular, being of depth smaller than the diameter of the gasket 33. The grooves such as the groove 50 connect to each other so as to make up a continuous groove, and they also connect at their connection points with the longitudinal grooves 47 and 48 in the longitudinal assembly surface 30.

To assemble the pump of the invention, the first annular end portion 34 of the gasket 33 is engaged in the annular groove 46 of the axial nose 44 of the first fitted end piece 31, and then the first half-shell 101 is applied sideways against the axial nose 44. The longitudinally-extending portions 36 and 37 of the gasket 33 are engaged in the longitudinal grooves 47 and 48, and a first half of the second annular end portion 35 of the gasket 33 is engaged in the groove 50. It is then possible to mount the rotors and it is easy to position the rotor lobes in the compression chambers 4–8. Thereafter, the second half-shell 102 can be applied laterally both against the axial nose 44 and against the longitudinal assembly surface 30, with the second half of the second annular end portion 35 of the gasket 33 being inserted in the corresponding front-end groove of the second half-shell 102. Thereafter the second fitted end piece 32 can be brought axially against the end faces such as the face 49 of the half-shells 101 and 102.

Such a pump can be assembled much more quickly than the prior art pumps in general use. Simultaneously, sealing is provided in a manner that is very effective and satisfactory.

The invention applies in particular to making a multistage primary pump of the Roots type, or of the claw type, or of the Roots-and-claw type.

The present invention is not limited to the embodiments described explicitly above, but includes the various generalizations and variants that are within the competence of the person skilled in the art.

What is claimed is:

1. A multistage dry vacuum pump selected from a group consisting of Roots type multistage pumps, claw type pumps, and combined Roots-and-claw type pumps, and made up of a plurality of compression stages placed in series, the pump having at least one rotor mounted to rotate in a stator that is closed at its ends by two fitted pieces, the stator being made by radially assembling together two half-shells on a longitudinal assembly surface, each compression stage thus being contained in two corresponding portions of each of the half-shells, the two half shells, once assembled together, containing all of the compression stages, wherein a continuous one-piece gasket serves to provide both peripheral radial sealing in the longitudinal assembly surface of the half-shells, and axial end sealing between the half-shells and the fitted end pieces so as to isolate the compression stages from the outside atmosphere.

2. The vacuum pump according to claim 1, wherein the gasket comprises two annular end portions that are generally parallel to each other and that are interconnected by two longitudinally-extending portions that are generally perpendicular thereto.

3. The vacuum pump according to claim 2, wherein, in the assembled state, the longitudinally-extending portions of the gasket are compressed laterally between the two half-shells in the longitudinal assembly surface, while the two annular end portions are compressed between the two half-shells acting together on the one hand and the respective fitted end pieces on the other hand.

4. The vacuum pump according to claim 3, wherein at least one of the half-shells has two longitudinal grooves in its longitudinal assembly surface for receiving the longitudinally-extending portions of the gasket.

5. The vacuum pump according to claim 3, wherein the second annular end portion of the gasket is compressed axially by the second fitted end piece against the end faces of the two half-shells.

6. The vacuum pump according to claim 5, wherein the two half-shells comprise respective grooves in their second end faces, which grooves are shaped to receive said second annular end portion of the gasket.

7. The vacuum pump according to claim 2, wherein a first fitted end piece has an axial nose shaped to occupy a corresponding axial recess in the first end of the stator body as made up by the two assembled-together half-shells, the first annular end portion of the gasket being compressed radially by the two half-shells against the axial nose.

8. The vacuum pump according to claim 7, wherein the axial nose includes a peripheral annular groove for receiving said first annular end portion of the gasket.

9. The vacuum pump according to claim 2, wherein the gasket is substantially circular in cross-section and is received in grooves of rectangular cross-section.

10. The vacuum pump according to claim 2, wherein:

the longitudinal assembly surface is plane and contains the axes of two coupled-together rotor shafts;

the longitudinally-extending portions of the gasket are generally parallel to each other and connected to the annular end portions in respective connection zones that are diagrammatically opposite in pairs.

11. The vacuum pump according to claim 1, wherein it constitutes a multistage primary pump of the Roots type, or of the claw type, or of the combined Roots-and-claw type.

* * * * *